US006805133B2

(12) United States Patent
Matsumura et al.

(10) Patent No.: US 6,805,133 B2
(45) Date of Patent: Oct. 19, 2004

(54) APPARATUS FOR STABILIZING AIR PERMEABILITY CHARACTERISTIC OF FILTER CIGARETTES

(75) Inventors: Takeshi Matsumura, Tokyo (JP); Yasuyuki Takagi, Shizuoka (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/256,140

(22) Filed: Sep. 27, 2002

(65) Prior Publication Data

US 2003/0024539 A1 Feb. 6, 2003

Related U.S. Application Data

(63) Continuation of application No. PCT/JP01/02483, filed on Mar. 27, 2001.

(30) Foreign Application Priority Data

Mar. 28, 2000 (JP) ..... 2000-089388

(51) Int. Cl.[7] ..... A24C 5/26

(52) U.S. Cl. ..... 131/68; 131/69; 131/90; 131/284

(58) Field of Search ..... 131/69, 68, 88, 131/94, 2, 84, 35, 37, 90; 118/200, 230, 235, 244, 258

(56) References Cited

U.S. PATENT DOCUMENTS

| | | | | |
|---|---|---|---|---|
| 2,984,245 A | | 5/1961 | Phillips, Jr. | |
| 4,104,431 A | | 8/1978 | Luke | |
| 4,265,255 A | * | 5/1981 | Helms | 131/69 |
| 5,611,359 A | | 3/1997 | Ogura et al. | |
| 5,911,224 A | | 6/1999 | Berger | |
| 6,619,292 B2 | * | 9/2003 | Saitou | 131/68 |
| 2001/0006067 A1 | * | 7/2001 | Saitou | 131/88 |

FOREIGN PATENT DOCUMENTS

| | | |
|---|---|---|
| EP | 0 674 851 A1 | 10/1995 |
| GB | 782415 A | 9/1957 |
| JP | 05-268928 A | 10/1993 |
| JP | 7-45200 Y2 | 10/1995 |
| JP | 2000-93151 A | 4/2000 |
| WO | 00/11975 A | 3/2000 |

* cited by examiner

*Primary Examiner*—Dionne A. Walls
(74) *Attorney, Agent, or Firm*—Birch, Stewart, Kolasch & Birch, LLP

(57) ABSTRACT

An apparatus for stabilizing air permeability characteristic of filter cigarettes has a drying unit (20) for preliminarily drying a tip-paper web (W) in the process of supplying the web (W) to a rolling section of a filter attachment machine. The drying unit (20) heats and dries the web (W) with a heater block (22), to thereby stabilize the water-content of the web (W) in an absolute dry region which is a lower water-content region as compared with a normal water-content region.

6 Claims, 8 Drawing Sheets

APPARATUS FOR STABILIZING AIR PERMEABILITY CHARACTERISTIC OF FILTER CIGARETTES

This application is a Continuation of copending PCT International Application No. PCT/JP01/02483 filed on Mar. 27, 2001, which was not published in English and which designated the United States, and on which priority is claimed under 35 U.S.C. §120, the entire contents of which are hereby incorporated by reference.

TECHNICAL FIELD

The present invention relates to an art of manufacturing filter cigarettes of a type designed to take air into a filter through small holes in a tip-paper piece to thereby achieve a desired dilution characteristic, and especially to a filter cigarette air permeability characteristic stabilization device for stabilizing the ratio of the amount of the air which flows into a filter through small holes in a tip-paper piece.

BACKGROUND ART

The taste of a filter cigarette of this type depends on its dilution characteristic, and the dilution characteristic depends much on the amount of air taken in, especially taken in through a filter. Specifically, the higher the degree of dilution, the milder the cigarette tastes. Conversely, the lower the degree of dilution, the stronger the cigarette tastes. Hence, in order to ensure that manufactured filter cigarettes (products) have stable quality, it is required to stabilize the ratio of the amount of the air which flows through a filter to the amount of the air which flows through an entire filter cigarette (this ratio will be hereinafter referred to as "air-flow ratio").

One of the causes of difference in air-flow ratio between products is difference in space between the circumference of a filter-tip and a tip-paper piece (hereinafter, this difference will sometimes be referred to as "difference in circumferential tip space"). Thus, there is found large difference in circumferential tip space, among all manufactured products. Specifically, when a tip-paper piece is rolled around the circumference of a filter-tip more tightly, the space between the circumference of the filter-tip and the tip-paper piece is smaller. Hence, air-flow resistance in small holes is larger, and accordingly, the ratio of the air flowing into the filter is lower. Conversely, when a tip-paper piece is rolled around the circumference of a filter-tip less tightly, the space between the circumference of the filter-tip and the tip-paper piece is larger. Hence, air-flow resistance in small holes is smaller, and accordingly, it can be said that the air-flow ratio tends to be higher.

In this connection, for example, Japanese Patent Unexamined Publication No. H5-268928, Japanese Utility Model Examined Publication No. H7-45200 etc. disclose a technique in which, when a tip-paper piece is rolled around a cigarette and filter-plug in a filter attachment machine, rolling of the tip-paper piece is performed following rotation of the cigarette and filter-plug stably, to thereby prevent inappropriate rolling of the tip-paper piece. It is recognized that, in the technique known from those publications, glue on the tip-paper piece is preliminarily dried prior to rolling of the tip-paper piece, to enhance the initial adhesive power of the glue to thereby help stable rolling of the tip-paper piece.

However, paper like tip-paper has a material property such that, when it is dried, fibers shrink as the water content thereof decreases. Here, the larger the reduction in water content of paper, the larger the fiber shrinkage tends to be. In manufacturing filter cigarettes, if the water content of a tip-paper web as a material is not uniform, tip-paper pieces, which are cut from the tip-paper web, shrink to different degrees of shrinkage (at different shrinkage percentages) when glue on them is dried after they are rolled around half-finished filter cigarettes, respectively. The difference in shrinkage percentage between tip-paper pieces leads to difference in the above-mentioned circumferential tip space between products, and hence difference in air-flow resistance in small holes. Thus, in manufacturing filter cigarettes, the ratio of the air flowing into a filter cannot be stabilized perfectly, only by preventing inappropriate rolling of a tip-paper piece.

In this connection, it is conceivable, in manufacturing filter cigarettes, to keep rolls of tip-paper web as a material under control so that they may have the same water content all the time, to thereby keep the percentage of shrinkage caused by glue-drying within a certain range. However, in paper factories, printing factories and tobacco-manufacturing factories, conditions such as humidity, temperature, etc. under which tip-paper webs are stored are different. In addition, the water content of a tip-paper web varies depending on countries and regions of the world, and are much affected by external factors such as seasons, change in weather, etc. in different regions and countries. Thus, it is technically very difficult to keep all rolls of tip-paper web as materials in the same water-content condition, under normal environmental conditions of existing factories.

DISCLOSURE OF THE INVENTION

The present invention has been made in order to achieve many objects. One of the objects is to make it possible to manufacture high-quality filter cigarettes, without adding large-scale new equipment.

One mode of an apparatus for stabilizing air permeability characteristic of filter cigarettes according to the present invention can be carried out, for example, by modifying filter cigarette manufacturing equipment. Specifically, it is designed to dry a tip-paper web forcibly in the process of supplying the tip-paper web to a rolling section of a filter attachment machine, to thereby stabilize the water content of a tip-paper piece, which is to be rolled around a cigarette and filter-plug, in an absolute dry region. It is however to be noted that the present invention is not restricted to a mode achieved by modifying cigarette manufacturing equipment. It may be of a mode such that all the structure is built separately anew.

As stated above, the water content of a web as a material varies depending on environmental conditions. The normal range of water content is defined depending on environmental conditions of a country or region where filter cigarettes are to be manufactured. For example, in Japan, normally, the water content of a web is, on average, in a region of about 4% and above, throughout the year. It can be said that also in other countries and regions, the water content of a web is lower, for example, in dry climate, and higher in humid climate.

As stated above, the range of water content of a web varies as environmental conditions vary. However, it can be said that the water content of a web has a lower limit which depends on the environmental conditions of a country or region. The present invention intends to eliminate the influence of difference in water content of a web (material) upon manufactured filter cigarettes (products), by preliminarily drying the web to thereby lower, in advance, the range of water content of the web into an absolute dry region, which is a lower water-content region as compared with a normal water-content region.

For example, in a filter attachment machine suited for high-speed operation, a double-length cigarette received from a cigarette making machine is divided in two, and a filter-plug of twice the length of a filter-tip is arranged between those two cigarettes in the manner that the two cigarettes and the filter-plug are in line, to thereby form a half-finished double-filter cigarette. The half-finished product is supplied to a rolling drum in a rolling section. While the half-finished double-filter cigarette as a whole rolls on the rolling drum, a tip-paper piece is rolled around the half-finished double-filter cigarette, to thereby form a double-filter cigarette. A tip-paper web is drawn out continuously from a roll. While the web is guided along a feed path, glue is applied to one side thereof in accordance with a predetermined pattern. Then, the web is cut into tip-paper pieces. Each tip-paper piece is supplied to the rolling section, where the tip-paper piece is rolled around two cigarettes with a filter-plug between, in the manner that the tip-paper piece covers the filter-plug and one end of each cigarette. Then, glue is dried.

In the present invention, since the water-content of a tip-paper piece is, in advance, stabilized in an absolute dry region, i.e., a lower water-content region as compared with a normal water-content region, variation of the water-content of a tip paper piece which happens when glue is dried after the tip-paper piece is rolled is stable, that is, not very different between tip-paper pieces. Thus, the shrinkage percentage of a tip-paper piece is stable, that is, it is in a limited range. Thus, the space between the circumference of a filter-tip and a tip-paper piece does not vary irregularly between products. When products are made to have the same circumferential tip space, difference in air-flow resistance in holes between products is restricted. Thus, the ratio of the air flowing into a filter is stabilized.

In the present invention, web drying means may comprise a heater for heating a web, which is arranged halfway on a web feed path, and a control unit for controlling heating temperature at which the heater heats. In this case, when a web is drawn out, the heater heats the web, which passes the heater touching a heating surface thereof, to thereby lower the water content of the web into an absolute dry region. The control unit decides the amount of heat required to lower the water content of a web into an absolute dry region only by the heating surface of the heater touching the traveling web, and controls the heating temperature at which the heater heats. Here, it is to be noted that the heater is only an example. The drying means is not restricted to a heater.

In order to lower the water content of a web into an absolute dry region, it is desirable that the heater's heating temperature is controlled in a temperature region of 200° C. and above. In this case, when a web is drawn out in an actual filter attachment machine, the heater gives heat enough to preliminarily dry the web.

The heater's heating temperature can be varied taking account of the speed at which a tip-paper web travels. Specifically, when a tip-paper web travels at lower speed, the heater's heating temperature is set at lower temperature. Conversely, when a tip-paper web travels at higher speed, the heater's heating temperature is set at higher temperature. To sum up, what is needed is that heat enough to lower the water content of a travelling web into an absolute dry region is transferred from the heater. The heater's heating temperature does not always need to be 200° C. or higher.

When the present invention further comprises means for making the heater and a web approach or recede from each other, it is possible to make space between the heating surface of the heater and a web when the web, which has been being drawn out, is stopped, to thereby keep the web from being damaged by overheating.

In a desirable mode of the present invention, the drying means further comprises a water-content sensor for detecting the water content of a web, at least at one position which is behind or ahead of the heater, and sending out a detection signal. The control unit controls the heater's heating temperature on the basis of a detection signal from the water-content sensor. In this case, the heating temperature is controlled dynamically, depending on the detected water-content of a web. This makes the water content after drying more stable.

In the case where the water-content sensor detects the water content of a web at a position behind the heater, the heater's heating temperature is controlled in the form of proportional control (open loop) on the basis of a detection signal from the water-content sensor. The control unit calculates the amount of heat required for drying a web on the basis of the detected water content proportionally, and decides the heater's heating temperature.

In the case where the water-content sensor detects the water content of a web at a position ahead of the heater, the heater's heating temperature is controlled in the form of feedback control on the basis of a detection signal from the water-content sensor. The control unit corrects, i.e., raises or lowers the heater's heating temperature so that the detected water content may be in a dry region. In the case where the water content of a web is detected both at a position behind the heater and at a position ahead of the heater, the control unit can perform both proportional control and feedback control on the basis of two detection signals. It is to be noted that in the present invention, it is not always necessary to use the control unit and water sensor.

For example, the absolute dry region may be defined as a water-content region of 4% and below in terms of the water-content of a tip-paper piece, depending on environmental conditions of a country or a region. Let us suppose that a web is preliminarily dried by the apparatus for stabilizing air permeability characteristic according to the present invention. In that case, a web which had a higher water content before drying has its water content lowered to a larger degree. A web which had a lower water content before drying has its water content lowered to a smaller degree. Thus, when the water content of a web is lowered into a water-content region of 4% and below by preliminary drying, the web as a whole has a compressed, narrow range of water content as compared with the range of water content before drying. This means that the water-content of a web is stable in a region of 4% and below. Further, when, in the filter attachment machine, a tip-paper piece is rolled and then glue is dried (this is not preliminary drying), the influence of variation of the water content of the tip-paper piece upon the shrinkage percentage thereof is larger in the case where the tip-paper piece had a higher water content before drying, and smaller in the case where the tip-paper piece had a lower water content before drying. Thus, when the water content of a web is lowered into a low water-content region of 4% and below prior to rolling of tip-paper pieces, the range of shrinkage percentage which the tip-paper pieces show after rolling is compressed and narrowed. Thus, products have stable circumferential tip space. It is to be noted that this does not mean that in all countries and regions, the water content of a web needs to be lowered into a water-content region of 4% and below. The absolute dry region should be defined depending on environmental conditions of a country or region where the present invention is carried out.

BEST MODE OF CARRYING OUT THE INVENTION

The best mode of an apparatus for stabilizing air permeability characteristic of filter cigarettes according to the present invention can be carried out, for example, by modifying a filter attachment machine which is connected to a cigarette making machine. However, all the components of the present invention may be produced anew.

Figure 1:
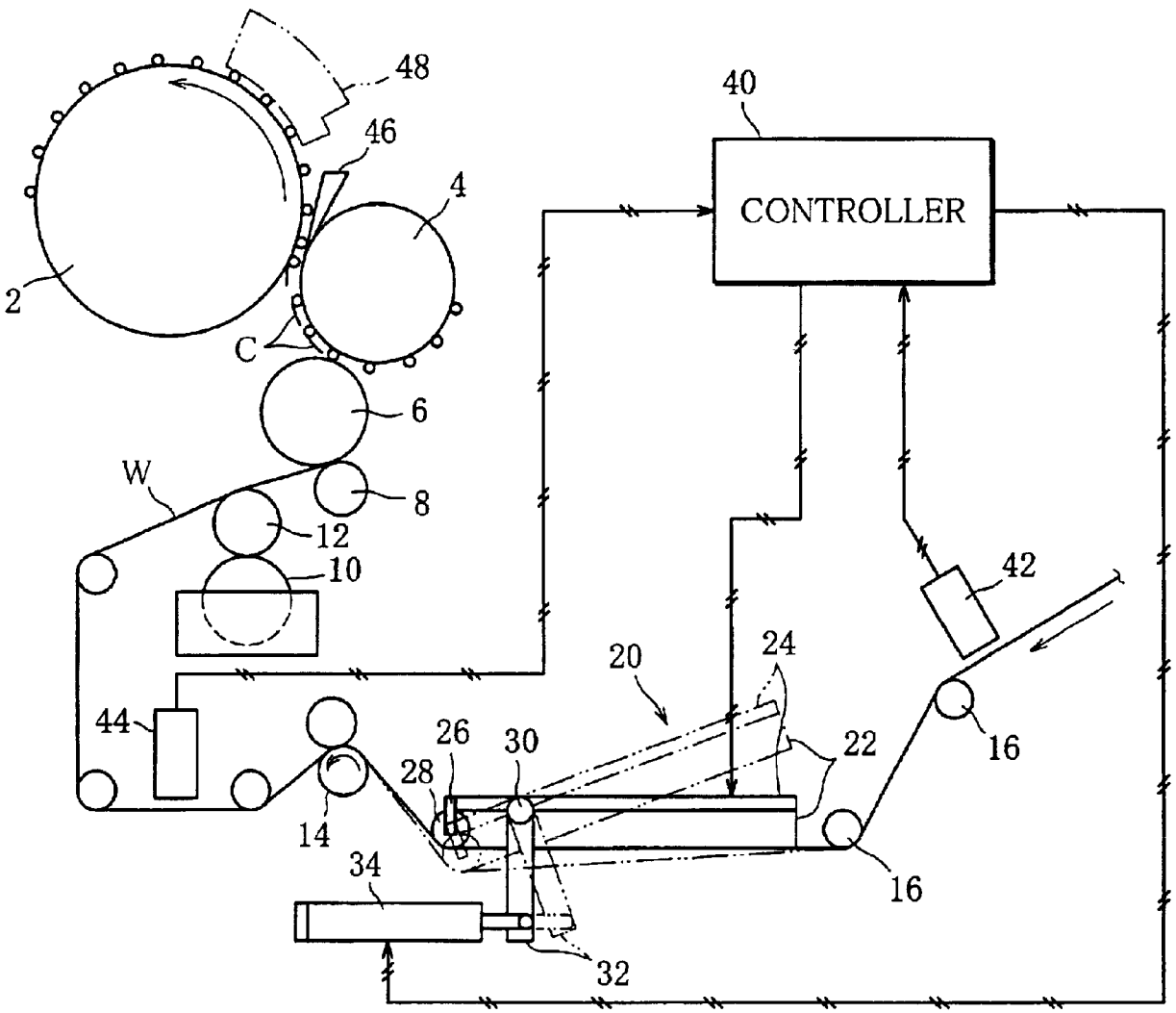
FIG. 1 is a schematic illustration of one mode of an apparatus for stabilizing air permeability characteristic.

With reference to FIG. 1, a filter attachment machine has a rolling (heater) drum 2 in its rolling section. Next to the rolling drum 2 is arranged a carrying drum 4. The carrying drum 4 holds, on its circumferential face, cigarettes and filter-plugs arranged in lines. In the present example, cigarettes and filter-plugs are so arranged that two cigarettes are placed on the opposite ends of a filter-plug to form a line. The filter-plug is twice the length of a filter-tip. Two cigarettes and one filter-plug arranged this way form a half-finished double-filter cigarette.

Next to and under the carrying drum 4 is arranged a cork drum 6. The cork drum 6 rotates holding tip-paper pieces C on its circumferential face by suction, to thereby supply tip-paper pieces C to cigarettes and filter-plugs on the carrying drum 4.

Tip-paper pieces C are obtained by cutting a long tip-paper web W into pieces of a predetermined length. Specifically, a drum 8 with a knife is arranged close to the cork drum 6, and a web W which is held on the circumferential face of the cork drum 6 by suction is cut into tip-paper pieces C by a rotating cork-knife (not shown).

Behind the cork drum 6, glue is applied to one side of a tip-paper web W. A glue roller 10 rotates with its lower part sunk in a glue liquid. Glue on the circumferential face of the glue roller 10 is transferred to the circumferential face of a transmission roller 12 which rotates in contact with the glue roller 11, to form a layer of a predetermined thickness. As the web W travels, the transmission roller 12, which rotates in contact with one side of the web, applies glue to the web in accordance with a predetermined application pattern. Specifically, glue is applied avoiding areas around small holes in tip-paper (described later) so that the small holes may not be filled with glue. Here, it is to be noted that glue is applied to the areas which will form lap portions of tip-paper pieces C.

A web W feed path extends from a roll of web (not shown) to a rolling section. A web W drawing-out roller 14 is arranged on the feed path. A web W is drawn out along the feed path, being guided by a plurality of guide rollers 16 etc., and supplied to the cork drum 6.

Halfway on the feed path, for example, behind the drawing-out roller 14 is arranged a drying unit 20. The drying unit 20 includes a heater block 22. The heater block 22 extends along the feed path over a predetermined length. The heater block 22 has a width in the width direction of a web W, and has its heating surface touching the web W over the entire width of the web W.

The heater block 22 is supported by means of a support plate 24, on its upper side. The support plate 24 projects beyond the heater block 22, that is, extends along the feed path further ahead than the heater block 22 extends. A guide roller 28 is fitted to the support plate 24, at the end of its projecting portion, by means of brackets 26. The guide roller 28 guides a web W, at a position ahead of the heater block 22. The support plate 24 is supported by a machine frame (not shown), at a position between the heater block 22 and the guide roller 28. Specifically, the support plate 24 has a shaft 30 at that position, which shaft 30 extends across the feed path. The shaft 30 is supported by the machine frame, with the help of bearings (not shown). Thus, the support plate 24 can turn on the shaft 30, relative to the machine frame.

The support plate 24 has also a lever 32 which extends downward from the above-mentioned position. The lever 32 is fitted to the shaft 30, at its upper end. Under the heater block 22, an air cylinder 34 is arranged horizontally, where the web W feed path runs between the heater block 22 and the air cylinder 34. A piston rod of the air cylinder is joined to the lower end of the lever 32 by means of a pin. In FIG. 1, the air cylinder 34 with its piston rod contracted is depicted with solid lines. In this state, the heater block 22 is held to touch a web W. When the piston rod of the air cylinder 34 is expanded, it makes the lever 32 turn on the shaft 30 toward the upstream side of the feed path. As a result, as depicted with two-dot chain lines, the support plate 34 takes a slanting position relative to the web W, and the heater block 22 recedes upward from the feed path. At that time, between the guide roller 28 fitted to the support plate 24 and the guide roller 16 immediately behind the guide roller 28, the web W changes its position downward, to thereby separate from the heater block 22.

To the drying unit 20 is connected a control unit for controlling heating temperature at which the heater block 22 heats, i.e., a controller 40. Let us suppose that the present mode of the invention is carried out, for example, in Japan, and that the initial water content of a web W as a material is in a normal water-content region. By setting the heater-block 22 heating temperature in a high temperature region of 200° C. and above, the water content of the web W can be satisfactorily reduced to 4% or lower. Only, it is better to decide the heater-block 22 heating temperature, considering the web W traveling speed, appropriately, because the web W traveling speed varies depending on the speed at which the filter attachment machine is operated.

The country or region where the present invention is carried out, the heating temperature at which the heater block 22 heats, and the water content of a web are not restricted, in particular. In a country other than Japan, the water content of a web W can be reduced to 4% or lower, with the same heating temperature. In some countries, the water content of a web W can be more reduced with the same heating temperature.

In the present mode of the invention, in order to stabilize the water content of a web W more satisfactorily, it is arranged that a target water content of a web W can be fed to the controller 40 at a user's discretion. The controller 40 includes a control system for controlling the heater-block 22 heating temperature in accordance with a target water content. Specifically, water-content sensors 42 and 44 are arranged near the feed path behind and ahead of the heater block 22, respectively. The water-content sensors 42 and 44 detect the water content of a web which is being drawn out, and send detection signals to the controller 40.

By choosing the to-be-processed detection signal, the controller 40 can control the heater-block 22 heating temperature in the form of proportional control (open loop) or in the form of feedback control. Specifically, when the detection signal from the water-content sensor 42 arranged behind the heater block 22 is chosen, the controller 40 performs proportional control. In that case, if a target water content is fed to the controller 40 in advance, the controller 40 calculates, on the basis of the detected water content, the amount of heat required to dry a web W up to the target water content, proportionally. Then, on the basis of the calculated amount of heat, the controller 40 decides the heater-block 22 heating temperature.

On the other hand, when the detection signal from the water-content sensor 44 arranged ahead of the heater block 22 is chosen, the controller 40 performs feedback control. In that case, the controller 40 decides the control amount on the basis of the difference between the target water content and the feedback signal, and raises or lowers the heater-block 22 heating temperature.

It is possible to perform both the proportional control and the feedback control, by choosing both the detection signal from the water-content sensor 42 and the detection signal from the water-content sensor 44. In any form of control, the water content of a web W can be controlled so that the water content after drying may stably agree with the decided target water content. It is to be noted that the manner of control by the controller 40 is not restricted to the above-described proportional control and feedback control.

The controller 40 can also control the operation of the air cylinder 34. Specifically, to the air cylinder 34 is connected an air-pressure pipeline (not shown). The direction in which air-pressure is fed through the air-pressure pipeline can be changed by a solenoid valve. By sending an operation signal to the solenoid valve, the controller 40 can control the operation of the air cylinder 34, to thereby make the heater block 22 and a web W approach or recede from each other.

Specifically, when a signal for stopping the cigarette making machine or a signal for stopping the filter attachment machine is fed to the controller 40, the controller 40 operates the air cylinder 34 to separate the heater block 22 from a web W. In that case, when the web W stops, the web W is kept from being damaged by overheating. For example, the web W is kept from burning or from burning and sticking to the heater block 22.

In the rolling section, when a tip-paper piece C, which has been cut from the leading end of a web W, approaches closest to a corresponding half-finished double-filter cigarette placed on the carrying drum 4, the tip-paper piece C sticks to the half-finished double-filter cigarette. Then, the half-finished double-filter cigarette and tip-paper piece C kept in this state are carried onto the rolling drum 2. On the rolling drum 2, the half-finished double-filter cigarette, which consists of a filter-plug and cigarettes, is touched by a rolling member 46, which causes the half-finished double-filter cigarette as a whole to roll. During the rolling, the tip-paper piece C is rolled around the half-finished double-filter cigarette, to thereby form a double-filter cigarette. By being heated by the glue drying heater 48 and the rolling drum 2, glue on the tip-paper piece C is dried.

Next, embodiments where one mode of the present invention is applied to cigarette manufacturing equipment to actually manufacture filter cigarettes will be discussed.

Figure 2:
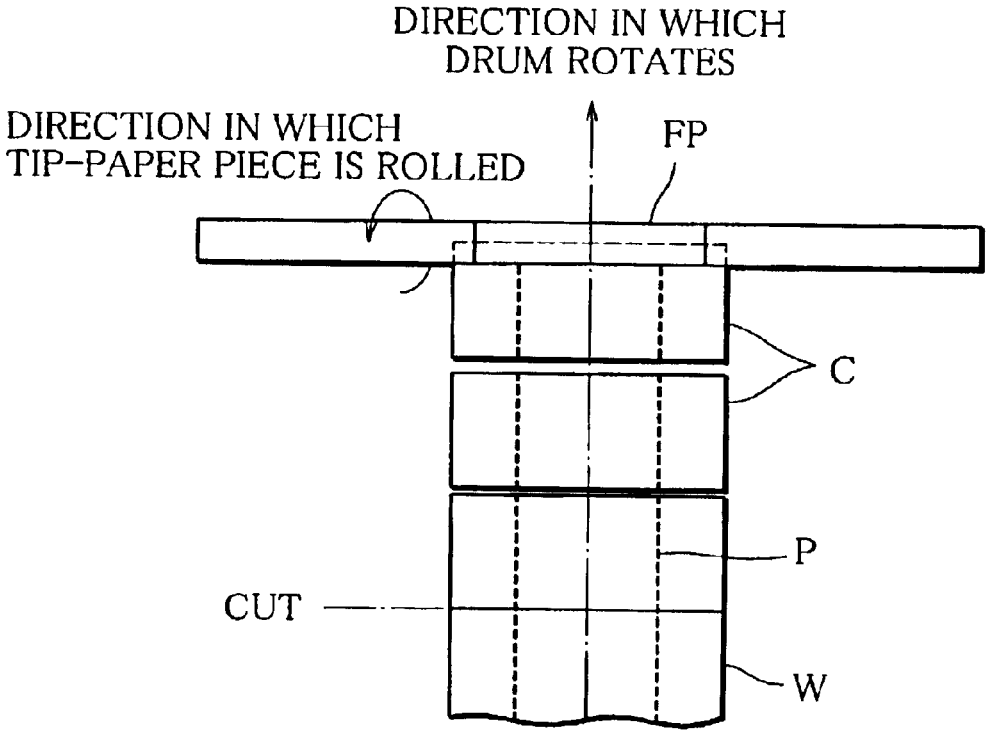
FIG. 2 is an illustration for explaining how tip-paper pieces are cut and rolled around cigarettes.

In each embodiment discussed below, let us suppose, for example, that 4000 of filter cigarettes are manufactured per minute, using an existing cigarette making machine and a filter attachment machine shown in FIG. 1. In each embodiment, a tip-paper web W having small holes P bored in advance is used. As shown in FIG. 2, the holes P are arranged in lines in the longitudinal direction of the tip-paper web W. Thus, when a tip-paper piece C is rolled around a filter-plug FP, holes P are arranged in rings surrounding the filter-plug FP. It is to be noted that a web W not having holes P bored in advance can be used. In that case, holes P can be bored at desired positions with a laser boring device or the like, for examples after a tip-paper piece C is rolled around a filter-plug, or while a web W is being drawn out. Thus, the way of boring holes in a web W or tip-paper pieces C is not restricted, in particular.

Glue is applied to a web W, for each to-be-cut tip-paper piece C, in accordance with a predetermined pattern. It is to be noted that except in lap portions (i.e., leading and trailing end portions of a tip-paper piece C as viewed in the direction in which the tip-paper piece C is rolled around a filter-plug), glue is applied avoiding areas around the holes P. Thus, in each embodiment discussed below, there is no need to consider the influence of water contained in glue applied to the areas around the holes P in the tip-paper piece C.

Preliminary Drying of a Web

When the filter attachment machine operates, a web is dried preliminarily by the above-described drying unit 20, before glue is applied to the web. Here, the heating temperature at which the heater block 22 should heat is set in a high temperature region of 200° C. and above. As shown in FIG. 1, the heater block 22 keeps its heating surface in contact with one side of the web W which is traveling.

Figure 3:
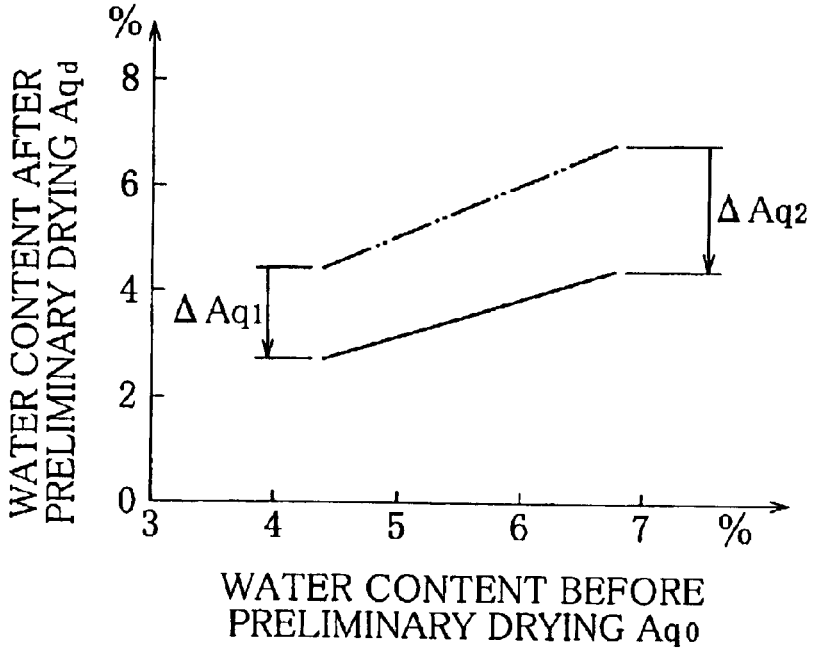
FIG. 3 is a graph showing how water content of a web varies through preliminary drying.

FIG. 3 shows relation between the initial water content $Aq_0$ of a web, i.e., the water content of a web before preliminary drying, and the water content $Aq_d$ of the web after preliminary drying. In FIG. 3, the two-dot chain line shows the case where the heater block 22 is not used. In this case, the water content of a web does not vary ($Aq_d=Aq_0$). Thus, the difference between the two-dot chain line and the solid line shows the decrease of the water content of a web achieved by preliminary drying.

As is clear from FIG. 3, a web is dried by heating by the heater block 22, and the water content of the web decreases in the entire range of the water content before preliminary drying. Here, the higher the water content before preliminary drying, the larger the variation of the water content ($=Aq_0-Aq_d$) is, and the lower the water content before preliminary drying, the smaller the variation of the water content is ($\Delta Aq_1<\Delta Aq_2$). From this variation characteristic of the water content, it is understood that the water content after preliminary drying has a compressed range as compared with the water content before preliminary drying.

After preliminary drying, the water content of a web has been lowered into a dry region of 4% and lower, which is lower than the normal range of the water content of a web. In this dry region, the range of the water content is stable.

Measurement of the Ratio of the Air Flowing into a Filter

Figure 4:
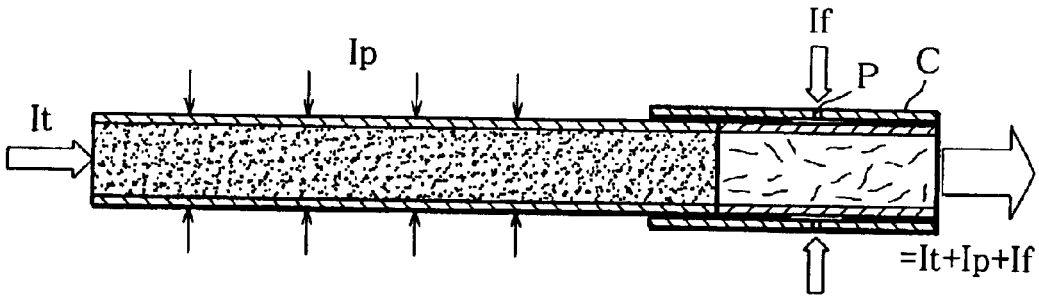
FIG. 4 is a cross-sectional view of a filter cigarette for explaining the air permeability characteristic of the filter cigarette.

FIG. 4 shows the air permeability characteristic of a filter cigarette. The ratio Vf of the air flowing into a filter to the air flowing through an entire filter cigarette is given by $$Vf=If/(It+Ip+If),$$

or $$Vf=If/(It+Ip+If)\times 100(\%),$$

where "It" is the amount of the air flowing in through a front opening of a cigarette-part, "Ip" is the amount of the air flowing in through wrapping paper in which the cigarette-part is wrapped, and "If" is the amount of the air flowing into a filter-part though holes P in a tip-paper piece C. Measurement of the air-flow ratio Vf can be performed on each product, using an inspection drum which is provided in the filter attachment machine for air-flow inspection of filter cigarettes.

Figure 5:
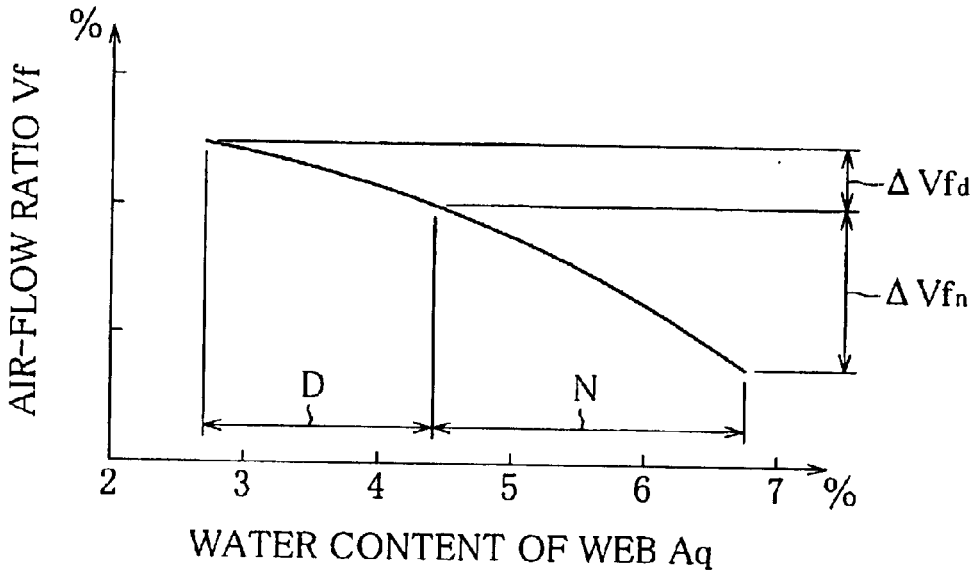
FIG. 5 is a graph showing relation between water content of a web and air-flow ratio Vf.

FIG. 5 shows relation between the measured air-flow ratio Vf and the water content of a web. As is clear from FIG. 5, the ratio Vf of the air flowing into a filter of a filter cigarette (product) varies, that is, becomes higher or lower depending on the water content of a web (material). Specifically, the higher the water content of a web, the lower the air-flow ratio Vf is. Further, the absolute value of the ratio of the variation of the air-flow ratio Vf to the variation of the water content ($=|\Delta Vf/\Delta Aq|$) is larger in a higher water-content region and lower in a lower water-content region.

When an embodiment is carried out in Japan, the water content of a web, which depends on the moisture-absorption characteristic of the web, is in the range of about 4% and above, in normal environmental conditions. For example, the water content of a roll of web varies depending on its region, and it is higher in a region nearer the circumference of the roll. Thus, the water content of a roll of web has a spread of about 4% to 7%.

In an embodiment, by preliminarily drying a web with the drying unit 20, the range of the water content is forcibly lowered from a normal region N to an absolutely dry region D, where the range of the water content is stable. When the water content of a web is lowered, the air-flow ratio Vf increases. Thus, preliminary drying of a web compresses the range of the water content into the dry region D, to thereby diminish the range of the variation of the air-flow ratio Vf due to the variation of the water content. In addition, the variation of the air-flow ratio Vf due to the variation of the water content is smaller in the dry region D than in the normal region N ($\Delta Vf_d<\Delta Vf_n$). Thus, in the dry region D, the influence of the water content of a web upon the air-flow ratio Vf is very small.

Comparison Between an Embodiment and a Comparative Example

From the comparison between an embodiment and a comparative example discussed below, the above-described effects of preliminary drying will become clearer.

Figure 6:
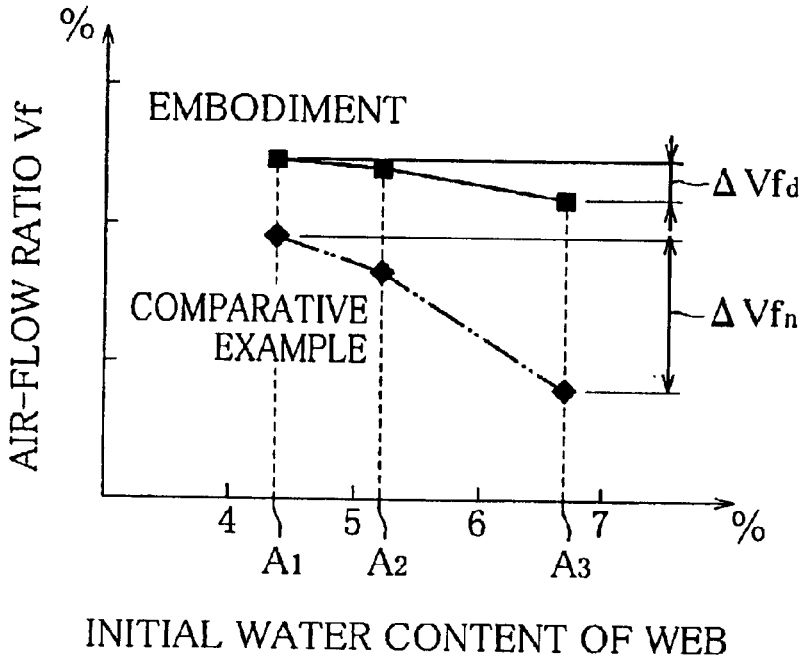
FIG. 6 is a graph showing how air-flow ratio Vf varies depending on initial water content of a web, which differs between an embodiment and a comparative example.

FIG. 6 shows relation between the initial water content of a web, i.e., the water content of a web before preliminary drying and the ratio Vf of the air flowing into a filter, which was obtained in an embodiment and in a comparative example. More specifically, the air-flow ratio Vf was measured in an embodiment and in a comparative example on the condition that the initial water content of a web was the same, where the embodiment and the comparative example were different in that preliminary drying was performed or not. The measurement was performed under different initial-water-content conditions ($A_1$~$A_3$), and the relation shown in FIG. 6 was obtained.

In FIG. 6, the solid line shows the relation between the initial water content and the air-flow ratio Vf obtained in the embodiment, and the two-dot chain line shows the relation obtained in the comparative example. From comparison between the embodiment and the comparative example, the following is clear: In the embodiment, due to preliminary drying of a web, the average air-flow ratio Vf is high, and the variation of the air-flow ratio Vf due to the variation of the water content (in the range of $A_1$~$A_3$) is restricted to a small range $\Delta Vf_d$ (for example, 3% or lower). The range $\Delta Vf_p$ of variation of the air-flow ratio Vf in the comparative example is larger (for example, 10% or higher) than in the embodiment.

Next, regarding the influence which the regional variation of water content in one roll of web has upon the air-flow ratio Vf, an embodiment and a comparative example are compared.

Figure 7:
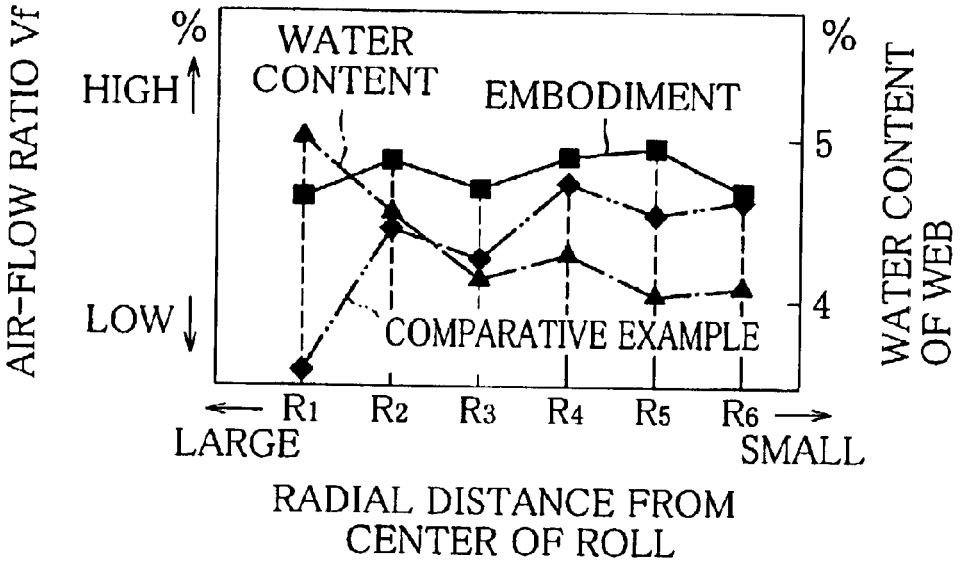
FIG. 7 is a graph showing relation between water content of a web and radial distance from the center of a roll of web, and how air-flow ratio Vf varies depending on radial distance from the center of a roll of web, which differs between an embodiment and a comparative example.

FIG. 7 shows relation between the water content of a roll of web and the radial distance from the center of the roll of web, and relation between the air-flow ratio Vf and the radial distance from the center of the roll of web which was obtained in an embodiment and in a comparative example. In FIG. 7, the radial distance from the center of a roll of web corresponds to the position between the leading end and the trailing end of a web as seen in the direction in which the web is drawn out. Specifically, a part having a smaller radial distance from the center of a roll of web, i.e., a part nearer to the center of the roll corresponds to a part nearer the trailing end of a web as seen in the direction in which the web is drawn out. Conversely, a part having a larger radial distance from the center of a roll of web corresponds to a part nearer the leading end of a web as seen in the direction in which the web is drawn out. As already stated, the water content of a roll of web (shown by the dot chain line) is higher in a part nearer the circumference of the roll of web, and lower in a part nearer the center of the roll of web.

The air-flow ratio Vf was measured in the embodiment and in the comparative example on the condition that the radial distance from the center of a roll was the same, where the embodiment and the comparative example were different in that preliminary drying was performed or not. The measurement of the air-flow ratio Vf was performed on parts having different radial distances ($R_1$~$R_6$) from the center of a roll, and the relation shown in FIG. 7 was obtained.

In FIG. 7, the solid line shows the relation between the radial distance from the center of a roll and the air-flow ratio Vf obtained in the embodiment, and the two-dot chain line shows the relation obtained in the comparative example. From comparison between the embodiment and the comparative example, the following is clear: In the embodiment, due to preliminary drying, the average air-flow ratio Vf is high, and regarding an entire roll of web (corresponding to $R_1$~$R_6$), that is, the entire length of a web, variation of the air-flow ratio Vf is restricted, or in other words, the air-flow ratio Vf is stable. In the comparative example, regarding one roll of web, the air-flow ratio Vf varies to a large extent. A part nearer the leading end of a web (part nearer the circumference of a roll of web) produces a lower air-flow ratio Vf, and a part nearer the trailing end of a web produces a higher air-flow ratio Vf.

Next, cigarette manufacturing equipment was operated continuously, and average air-flow ratio Vf was obtained for each group consisting of 20 products. 20 products form a retail unit (one pack). Regarding variation of the average air-flow ratio Vf during the continuous operation, an embodiment and a comparative example were compared. It is to be noted that filter cigarettes are not always packaged in groups of twenty, and that filter cigarettes are not always retailed by the pack.

Figure 8:
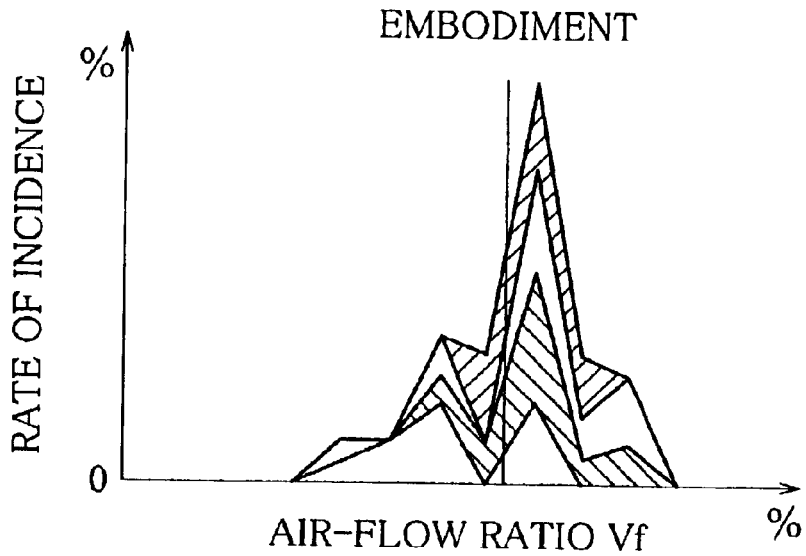
FIG. 8 is a graph showing relation between average air-flow ratio Vf for 20 products and rate of incidence, regarding an embodiment.
Figure 9:
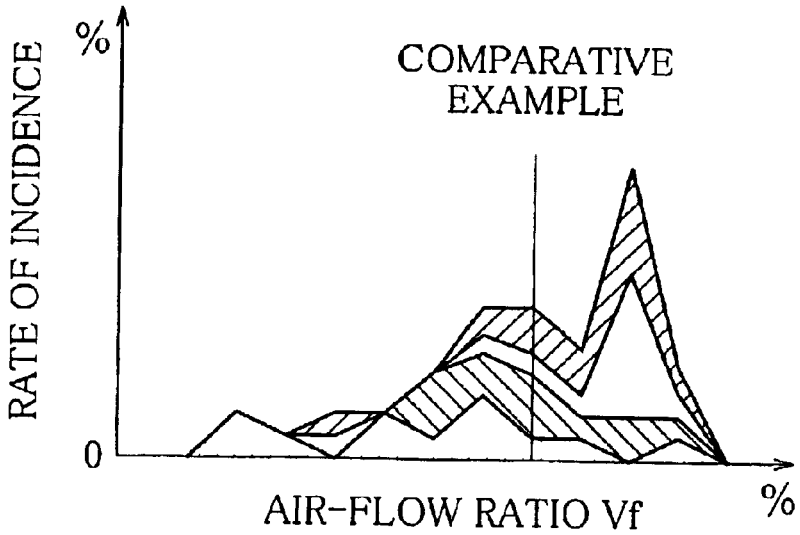
FIG. 9 is a graph showing relation between average air-flow ratio Vf for 20 products and rate of incidence, regarding a comparative example.

FIGS. 8 and 9 show relation between the average air-flow ratio Vf and the rate of incidence obtained in the embodiment and in the comparative example, respectively. As in the comparisons discussed above, the embodiment and the comparative example were different in that preliminary drying was performed or not. In FIGS. 8 and 9, four separate regions correspond to four sections into which a roll of web is divided depending on the radial distance from the center of the roll of web.

In the embodiment to which FIG. 8 relates, the arithmetic mean of the average air-flow ratios obtained during the continuous operation was 49.5%, and the standard deviation $\sigma$ was 1.47%. In the comparative example to which FIG. 9 relates, the arithmetic mean of the average air-flow ratios obtained during the continuous operation was 49.9%, and the standard deviation $\sigma$ was 2.37%.

When the embodiment and the comparative example are compared in respect of the variation of the average air-flow ratio Vf for 20 products on the basis of the above results, it is recognized that the embodiment shows improvement of about 38% in terms of the standard deviation. Thus, comparison between groups of actual retail products shows that the average air-flow ratio is stable.

Figure 10:
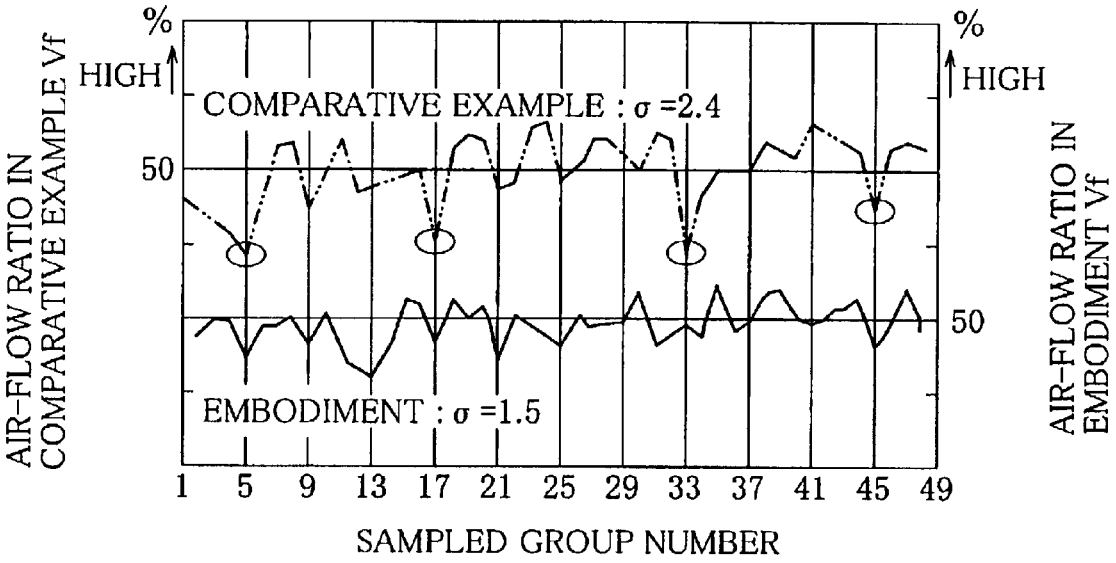
FIG. 10 is a graph showing time-series variation of average air-flow ratio Vf for 20 products, regarding an embodiment and a comparative example.

FIG. 10 shows variation of the average air-flow ratio Vf for 20 products obtained in time-series sampling performed in an embodiment and in a comparative example, each. Sampled groups of 20 products, for each of which groups the average air-flow ratio Vf was obtained, were numbered in chronological order. During continuous operation, by way of example, 12 rolls of web were used, one after another, continuously, to manufacture filter cigarettes. Each of odd numbers in FIG. 10 indicates a group of 20 products which was sampled immediately after a web from a succeeding roll was connected to a web from a preceding roll.

In FIG. 10, the solid line shows the variation of the average air-flow ratio obtained in the embodiment, and the two-dot chain line shows the variation of the average air-flow ratio obtained in the comparative example. In order to make difference between the variation in the embodiment and the variation in the comparative example clear, the variations are shown relative to different scales.

As already stated, the water content of a roll of web tends to be higher in a part nearer the circumference of the roll (see FIG. 7). Thus, in the comparative example, sometimes the average air-flow ratio Vf has a steep fall immediately after webs are connected, as marked with an ellipse in FIG. 10. Further, variation, i.e., rise and fall of the average air-flow ratio Vf throughout the sampling is large ($\sigma$=2.4). In contrast, in the embodiment, the average air-flow ratio Vf does not show a steep fall immediately after webs are connected, unlike the case with the comparative example. Further, variation, i.e., rise and fall of the average air-flow ratio Vf throughout the sampling is restricted to a small range ($\sigma$=1.5).

The above is the results of comparison between the embodiment and the comparative example in respect of variation of the average air-flow ratio Vf for a group of 20 products. Next, comparison is made between an embodiment and a comparative example in respect of difference ow in air-flow ratio Vf in one group of products (20 products).

Figure 11:
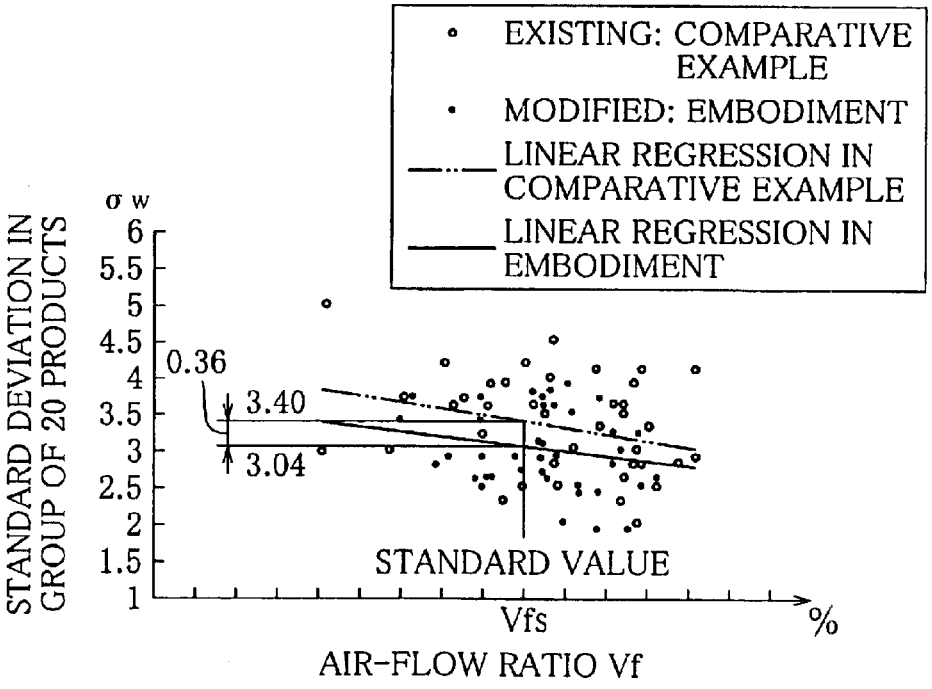
FIG. 11 is a graph showing relation between standard deviation ow in air-flow ratio in a group of 20 products and average air-flow ratio Vf for a group of 20 products, regarding an embodiment and a comparative example.

FIG. 11 is a graph where groups of 20 products manufactured in an embodiment and in a comparative example are plotted on the basis of the standard deviation $\sigma$w in air-flow ratio in a group of 20 products and average air-flow ratio Vf for the group of 20 products. From comparison between a linear regression (two-dot chain line) obtained in the comparative example and a linear regression (solid line) obtained in the embodiment, it is recognized that, in the entire range of air-flow ratio Vf, the standard deviation ow in air-flow ratio Vf in a group of 20 products is smaller in the embodiment than in the comparative example. At a standard value $Vf_s$ which is a target value of air-flow ratio predetermined in manufacturing filter cigarettes, the standard deviation $\sigma$w in the comparative example is 3.40 while the standard deviation $\sigma$w in the embodiment is 3.04. Thus, the embodiment shows improvement corresponding to the difference (=0.36). Thus, the air-flow ratio Vf is stable in a group of actual retail products.

Summary of Effects of the Embodiments

As stated above, in the embodiments in which preliminary drying is performed with the preliminary unit 20, average air-flow ratio Vf is relatively high and stable. Specifically, in the embodiment, the influence of the initial water content of a web upon the air-flow ratio Vf is much restricted, as compared with the comparative example. It is also recognized that variation of average air-flow ratio Vf for 20 products, throughout continuous operation of the cigarette-manufacuturing machine, and difference ow in air-flow ratio Vf in a group of 20 products are both restricted.

Verification of Stabilization of Air-Flow Ratio by Preliminary Drying of a Web

As already stated, it is known that the circumferential tip space, i.e., the space between the circumference of a filter-tip and a tip-paper piece, which space may vary between products, affects the ratio of the air flowing into a filter.

On the other hand, regarding why variation of the water content of a web as a material affects the air-flow ratio in a product, it is supposed that due to the variation of the water content of a web, tip-paper pieces show different shrinkage-characteristics when glue on the tip-paper pieces is dried, which leads to difference in the circumferential tip space between products.

The inventors paid attention to the above explanation of why variation of the water content affects the air-flow ratio, and ascertained that difference in the circumferential tip space could be technically controlled by giving a uniform shrinkage-characteristic to tip-paper pieces when glue on the tip-paper pieces was dried. On the basis of this understanding of the inventors, the idea of stabilizing the air-flow ratio by preliminary drying will be verified in the following way:

If relation between the shrinkage-characteristic and the water content of a tip-paper piece is made clear, it can be thought that stabilization of the water content of a web by preliminary drying leads to stabilization of the shrinkage characteristic of a tip-paper piece. Further, if clear correlation between the shrinkage-characteristic of a tip-paper piece and the air-flow ratio is found, it will be proved that the air-flow ratio in a product can be stabilized by stabilizing the shrinkage-characteristic of a tip-paper, to thereby technically restrict variation of the circumferential tip space.

An example of actual verification will be described below.

Figure 12:
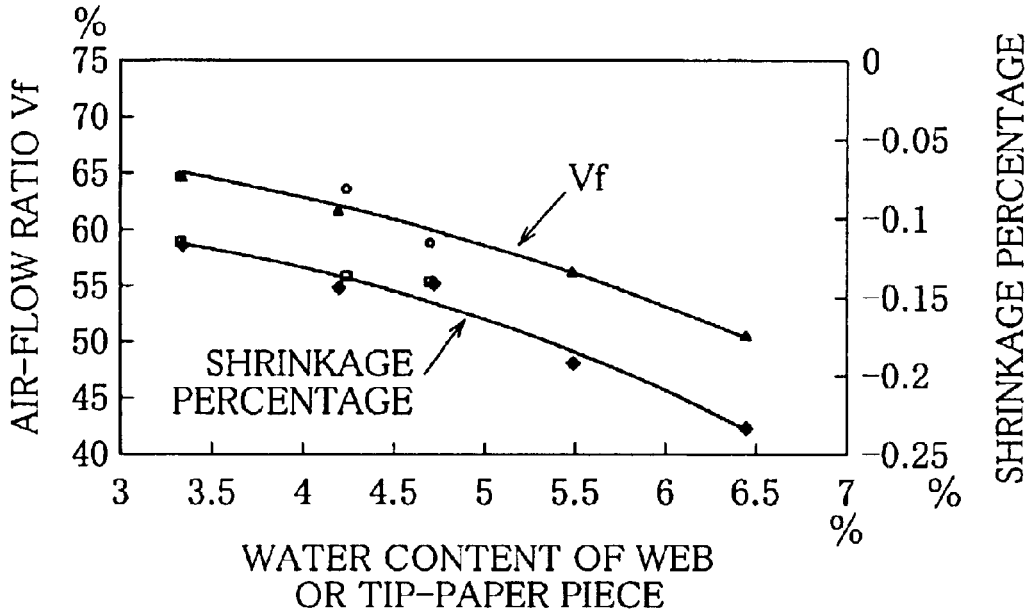
FIG. 12 is a graph showing relation between water content and shrinkage percentage of a web or tip-paper piece and relation between water content of a web or tip-paper piece and air-flow ratio Vf.

First, webs having different water-contents were cut into tip-paper pieces in actual filter cigarette manufacturing equipment, and glue on the tip-paper pieces was dried under the same conditions. The shrinkage percentage of each tip-paper piece and the air-flow ratio in each product were measured. FIG. 12 shows the results of the measurement. Regarding relation between the water content and the shrinkage percentage of a web or a tip paper piece and relation between the water content of a web or a tip paper and the air-flow ratio Vf in a product, it is clear, from the results shown in FIG. 12, that both the shrinkage percentage and the air-flow ratio Vf show similar dependence on the water-content of a web or a tip-paper piece.

Figure 13:
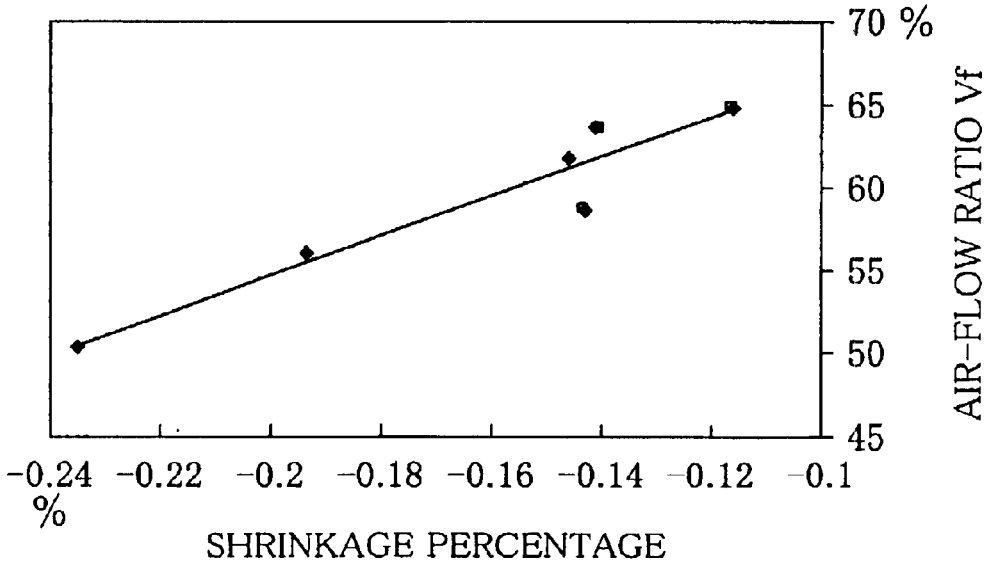
FIG. 13 is a graph showing relation between shrinkage percentage and air-flow ratio Vf.

Further, FIG. 13 shows, on the basis of the results of the above measurement, how the shrinkage percentage relates to the air-flow ratio Vf. From the shown relation, it is recognized that there is clear correlation between the shrinkage percentage and the air-flow ratio Vf.

As is clear from the above example of verification, correlation is found between the water-content of a web and the shrinkage percentage of a tip-paper piece, and between the shrinkage percentage and the air-flow ratio Vf. These correlations explain why the water-content of a web affects the air-flow ratio.

Next, how variation of the air-flow ratio is restricted by preliminary drying will be described.

Figure 14:
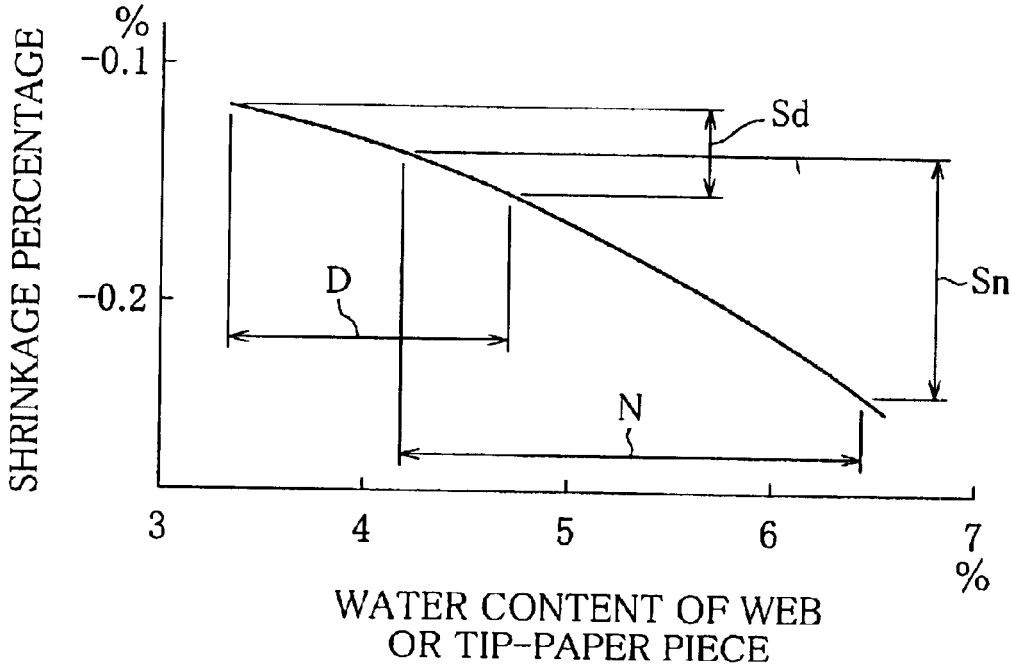
FIG. 14 is a graph for explaining how preliminary drying of a web affects the water content and shrinkage percentage of the web.

FIG. 14 shows relation between the water-content of a web or a tip-paper piece and the shrinkage percentage thereof in the process of drying glue thereon. As is clear from FIG. 14, the higher the water-content, the higher the shrinkage percentage of a tip-paper piece is. The influence of the water-content upon the shrinkage percentage is larger in a higher water-content region and smaller in a lower water-content region.

As already stated, preliminary drying of a web performed with the drying unit 20 not only lowers but also compresses the range of water content of the web into an absolute dry region (FIG. 3). In FIG. 14, when the water content of a tip-paper piece is in a normal region N, the shrinkage percentage is in a range $S_n$ on the basis of relation between the water-content and the shrinkage percentage. When the water-content of a tip-paper piece is lowered to a dry region D by preliminary drying of a web, the shrinkage percentage is in a range $S_d$. When the range $S_n$ and the range $S_d$ of shrinkage percentage are compared, it is found that, since the range of water-content is compressed by preliminary drying and the influence of the water-content upon the shrinkage percentage is smaller in a lower water-content region, the range $S_d$ after preliminary drying is far smaller than the range $S_n$ before preliminary drying. It is thought that the range of shrinkage percentage thus compressed by preliminary drying helps give a uniform shrinkage-characteristic to tip-paper pieces in the process of rolling the tip-paper pieces around respective cigarettes and drying glue on the tip-paper pieces. As a result, difference in the circumferential tip space between products is restricted.

To sum up, stabilization of the water-content of a web by preliminary drying has two effects: It compresses the range of water content to thereby restrict the influence of the water content upon the air-flow ratio; and reduces the influence of the water-content upon the air-flow ratio in an absolute dry region which is a lower water-content region as compared with a normal water-content region. It is thought that due to these two effects combined together, variation of the air-flow ratio is reduced to a large extent (reduced to half the variation in a conventional case, or more reduced).

In the above embodiments, the water content of a web or a tip-paper piece was stabilized in a dry region of 4% and below by performing proportional control or feedback control, or both proportional control and feedback control on the heater block 22 heating temperature, on the basis of a detection signal from the water-content sensor 42 or 44. However, it is also possible to lower the water content of a tip-paper piece to a dry region of 4% and below only by setting the heater block 22 heating temperature in a high temperature region of 200° C. and above, without performing proportional control or feedback control on the basis of a detection signal from the water-content sensor 42 or 44. Also in this case, the range of water content is compressed by preliminary drying in the above-described way. Thus, the water-content is stable in a dry region.

Modification can be made to the above-described mode of the apparatus for stabilizing air permeability characteristic according to the present invention. For example, instead of the heater block 22, a hot-air dryer, a heat-ray radiator, a high-frequency heater or the like may be used for preliminary drying of a web. The position of the drying unit 20 can be changed at will in a section where a web is being drawn out before glue is applied to it.

The mechanism for making the heater block 22 and a web approach or recede from each other may be designed to shift only one of them. The elements of the mechanism may be modified variously.

In a situation where the cigarette manufacturing machine may be stopped for some reason, the filter attachment machine may be operated at variable speed. In that case, the heating temperature at which the heater 22 heats may be varied in accordance with the variation of the speed at which a web travels. When a web travels at an extremely low speed, the heater block 22 may be placed apart from the web. Considering that the heater block 22 heating temperature is high, control like this is especially effective in preventing damage of a web due to overheating.

The form of the rolling section is not restricted to the described one in which the rolling drum 2 and the rolling member 22 are used. A filter attachment machine of a type different from the above described has a rolling plate, which is arranged along the circumference of the cork drum. Between a rolling guide face of the rolling plate and the circumference of the cork drum is formed a rolling passage for half-finished double-filter cigarettes. In this case, a rolling drum is not used in the rolling section, and a tip-paper piece is rolled around a half-finished double-filter cigarette, separating from the circumference of the cork drum.

In the embodiments, filter cigarettes were manufactured at a rate of 4,000 per minute. Needless to say, the present invention can be applied to the case where filter cigarettes are manufactured at a higher rate, for example, at a rate of 8,000 per minute or higher. In that case, it is desirable to arrange that when the manufacturing rate is higher, the heater block 22 heating temperature is higher, and that when the manufacturing rate is lower, the heater block 22 heating temperature is lower.

In the embodiments, regarding a web, the absolute dry region is defined, depending on the normal range of water content of a web in Japan. When the present invention is carried out in a country or a region where the environmental conditions are different, it is desirable to define the absolute dry region specifically, in accordance with the environmental conditions.

In the process of manufacturing filter cigarettes, the apparatus for stabilizing air permeability characteristic of filter cigarettes according to the present invention serves to stabilize the ratio of the air flowing into a filter. Thus, products that are stable in taste-quality, which depends on the air permeability characteristic of a product, can be provided.

In particular, if, taking the environmental conditions of a country or region into consideration, the water content of a tip-paper piece is lowered to a dry region of 4% and below by preliminary drying of a web, the influence of the water content of a web as a material upon the air-flow ratio in a product is half or further smaller, as compared with the case where the water content of a web is in a normal water-content region in that country or region.

The apparatus for stabilizing air permeability characteristic according to the present invention has many advantages. One of the advantages is that in the present invention, the air-flow ratio can be stabilized with a device of simple structure, which, for preliminary drying of a web, only uses a heater and a control unit for controlling the heater. Thus, the present invention can be carried out easily, only by modifying an existing cigarette manufacturing machine, without need to add large-scale equipment.

If the structure for preliminary drying includes a system for controlling the heater heating temperature, with the help of a water-content sensor, preliminary drying can be performed appropriately, in accordance with variation of the water content of a web, to thereby surely stabilize the water content after preliminary drying. In particular, in the case where relation between the heater heating temperature and the dry-characteristic of a web is clear, a system capable of performing proportional control is suitable. A system capable of performing feedback control can dynamically deal with variation of the water content, even when the dry-characteristic of a web is not clear. If those two systems are combined together, it can deal with difference between the dry-characteristic of a web and actual data.

If, taking the environmental conditions of a country or region into consideration, the heater heating temperature is set in a high temperature region of 200° C. and above, the amount of heat which is enough to lower the water content of a web from a normal region to an absolute dry region is obtained. Further, with a control system including a water-content sensor, stable temperature control can be performed.

If mechanism for preventing damage of a web by overheating, which tends to happen when the operation of the cigarette manufacturing equipment is stopped, is incorporated, the operation of the cigarette manufacturing equipment can be stopped without trouble and resumed smoothly to continue to manufacture cigarettes.

What is claimed is:

1. An apparatus for stabilizing air permeability characteristic of filter cigarettes, comprising:

a feed path extending up to a rolling section where, in order to attach a filter to a cigarette supplied from a cigarette making machine, a tip-paper piece is rolled around the cigarette in a state that a filter to be attached is arranged on one end of the cigarette;

feeding means for drawing out a tip-paper web along said feed path, applying glue at a glue position to one side of the web, cutting the glued web into tip-paper pieces and supplying the tip-paper pieces to said rolling section; and a web drying device for drying the web on said feed path to an absolute dry state thereof in terms of water-content of the web, when the web passes through a drying position located at an upstream side of the gluing position in said feeding means, wherein said web drying device comprises a heater located in said drying position, for heating the web, and shifting means for making said heater and the web approach or recede from each other;

a control unit for controlling heating temperature at which said heater heats, in a temperature range of 200° C. and above; and a water-content sensor for detecting water-content of the web, at least at one position which is located upstream or downstream of the heater as viewed in the direction in which the web is drawn out along said feed path, and sending out a detection signal, and said control unit controls the heating temperature at which said heater heats, on the basis of the detection signal from said water-content sensor.

2. The apparatus for stabilizing air permeability characteristic of filter cigarettes according to claim 1, wherein said control unit performs proportional control on the heating temperature at which said heater heats, on the basis of the detection signal which said water-content sensor sends out on the basis of detection performed at a position located downstream from said heater.

3. The apparatus for stabilizing air permeability characteristic of filter cigarettes according to claim 1, wherein said control unit performs feedback control on the heating temperature at which said heater heats, on the basis of the detection signal which said water-content sensor sends out on the basis of detection performed at a position located upstream from said heater.

4. The apparatus for stabilizing air permeability characteristic of filter cigarettes according to claim 1, wherein said control unit performs proportional control on the heating temperature at which said heater heats, on the basis of the detection signal which said water-content sensor sends out on the basis of detection performed at a position located downstream from said heater, and feedback control on the heating temperature at which said heater heats, on the basis of the detection signal which said water-content sensor sends out on the basis of detection performed at a position located upstream from said heater.

5. The apparatus for stabilizing air permeability characteristic of filter cigarettes according to claim 1, wherein said absolute dry state of the web is defined as 4% and below in terms of water-content of the web.

6. An apparatus for stabilizing air permeability characteristic of filter cigarettes, comprising:

a feed path extending up to a rolling section where, in order to attach a filter to a cigarette supplied from a cigarette making machine, a tip-paper piece is rolled around the cigarette in a state that a filter to be attached is arranged on one end of the cigarette;

feeding means for drawing out a tip-paper web along said feed path, applying glue at a gluing position to one side of the web, cutting the glued web into tip-paper pieces and supplying the tip-paper pieces to said rolling section; and a web drying device for drying the web on said feed path to an absolute dry state thereof in terms of water-content of the web, when the web passes through a drying position located at an upstream side of the gluing position in said feeding means, wherein said web drying device comprises a water-content sensor for detecting water-content of the web, at least at one position which is located upstream or downstream of the drying position as viewed in the direction in which the web is drawn out along said feed path, and sending out a detection signal, and controlling a heating temperature on the basis of the detection signal from said water-content sensor.

* * * * *